US007134625B2

(12) United States Patent
Lehrieder et al.

(10) Patent No.: US 7,134,625 B2
(45) Date of Patent: Nov. 14, 2006

(54) AUTOMATIC REEL CHANGER COMPRISING A REEL STAND AND A METHOD FOR DISPOSING OF RESIDUAL REEL CASINGS

(75) Inventors: Erwin Paul Josef Lehrieder, Gaukönigshofen (DE); Gert Liebler, Altertheim (DE); Josef Herbert Olbort, Mainbernheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 88 days.

(21) Appl. No.: 10/508,020

(22) PCT Filed: Feb. 26, 2003

(86) PCT No.: PCT/DE03/00617

§ 371 (c)(1),
(2), (4) Date: Sep. 27, 2004

(87) PCT Pub. No.: WO03/080488

PCT Pub. Date: Oct. 2, 2003

(65) Prior Publication Data

US 2005/0145744 A1 Jul. 7, 2005

(30) Foreign Application Priority Data

Mar. 26, 2002 (DE) ..... 102 13 462

(51) Int. Cl.
*B65H 19/12* (2006.01)
*B65H 67/02* (2006.01)

(52) U.S. Cl. ..... 242/559.2

(58) Field of Classification Search ..... 242/473.4, 242/474.5, 474, 559, 559.2, 559.3; 414/908, 414/910, 911

See application file for complete search history.

(56) References Cited

U.S. PATENT DOCUMENTS

| | | | | |
|---|---|---|---|---|
| 1,807,813 | A | | 6/1931 | White |
| 3,729,915 | A | * | 5/1973 | Mayer et al. ..... 57/271 |
| 3,964,723 | A | * | 6/1976 | Schippers et al. ..... 242/473.5 |
| 3,991,951 | A | | 11/1976 | Galletti |
| 4,131,206 | A | | 12/1978 | Kawada et al. |
| 4,386,741 | A | | 6/1983 | Weiss et al. |
| 5,249,756 | A | | 10/1993 | Biagiotti |
| 5,762,283 | A | | 6/1998 | Buchmeyer et al. |
| 5,934,604 | A | * | 8/1999 | Klimek ..... 242/559.4 |
| 6,039,284 | A | | 3/2000 | Lehrieder et al. |
| 6,138,938 | A | * | 10/2000 | Lehrieder et al. ..... 242/559.3 |
| 6,402,083 | B1 | | 6/2002 | Horn et al. |

FOREIGN PATENT DOCUMENTS

| | | |
|---|---|---|
| DE | 512019 | 10/1930 |
| DE | 78 17 607 | 9/1978 |
| DE | 29 18 848 | 8/1980 |
| DE | 42 15 739 A1 | 11/1993 |

(Continued)

*Primary Examiner*—William A. Rivera
*Assistant Examiner*—William E. Dondero
(74) *Attorney, Agent, or Firm*—Jones, Tullar & Cooper, PC

(57) ABSTRACT

An automatic roll changer including a reel stand having a holder. At least one roll of material is rotatably mounted in that holder. A transport device is provided for transporting either at least one new material roll or at least one spent reel casing from which the material originally on the reel casing has been at least partially unwound. The transport device is adapted to more transversely to the longitudinal axes of the mounted material reel and underneath the reel stand.

24 Claims, 2 Drawing Sheets

FOREIGN PATENT DOCUMENTS

| | | | |
|---|---|---|---|
| DE | 42 15 739 | C2 | 11/1993 |
| DE | 43 44 743 | A1 | 6/1995 |
| DE | 196 11 494 | A1 | 9/1997 |
| DE | 198 60 475 | A1 | 7/2000 |
| EP | 0 391 061 | A1 | 2/1990 |
| EP | 0 454 634 | A2 | 10/1991 |
| EP | 1 044 912 | A1 | 9/1997 |
| EP | 0 995 706 | A1 | 4/2000 |
| GB | 2 191 967 | A | 12/1987 |
| JP | 09012184 | A | 1/1997 |
| JP | 10120258 | A | 5/1998 |
| JP | 10181959 | A | 7/1998 |
| WO | WO 95/20537 | | 8/1995 |

* cited by examiner

AUTOMATIC REEL CHANGER COMPRISING A REEL STAND AND A METHOD FOR DISPOSING OF RESIDUAL REEL CASINGS

CROSS-REFERENCE TO RELATED APPLICATIONS

This patent application is the U.S. National Phase, under 35 U.S.C. 371, of PCT/DE2003/000617, filed Feb. 26, 2003; published as WO 2003/080488 A2 and A3 on Oct. 2, 2003, and claiming priority to DE 102 13 462.6, filed Mar. 26, 2002, the disclosures of which are expressly incorporated herein by reference.

FIELD OF THE INVENTION

The present invention is directed to a roll changer with a roll stand, and to a method for disposing of spent cores. A transport device is used to transport new rolls and spent cores.

BACKGROUND OF THE INVENTION

Roll changers are typically employed in connection with web-fed rotary printing, for example, and are used for feeding a web of material, for example a paper web, to a printing press. In web-fed rotary printing, the web of material to be imprinted is unwound from a roll of material. This roll of material is rotatably seated in the roll changer, and it is necessary to maintain a sufficient paper tension in the web when pulling the web of material off the roll of material. When a roll of material becomes almost exhausted, i.e. the web of material wound on the roll of material is substantially unwound, this exhausting or depleted roll of material must be replaced by another fresh roll of material. Therefore, at least two separate holders, for seating two separate rolls of material are provided in roll changers. A roll change from the old or exhausting roll to the new or fresh roll of material can be performed by a manual roll change while the press is stopped. Alternatively, this roll change can be accomplished by a flying roll change, or by a stopped roll change with a web storage device. As soon as the old web of material has been replaced by the fresh web of material, the spent core of the old roll of material is removed from the holder of the roll changer to make room for a fresh roll of material for the next roll change. In other words, following each roll change it is necessary to remove an unwound spent core from the roll changer.

The removal of the spent cores can be performed manually by the operator at the roll changer. If the removal of the used-up cores is intended to be performed automatically, a suitable logistic arrangement for the spent cores in required. It is known in the prior art to transport spent core containers to the roll changer following a roll change. The supply tracks, on which the fresh rolls of material are being transported to the roll changers, are also used for transporting the spent core containers. As a result, it is necessary to provide for the supply of the roll changers with fresh rolls of material and for the removal of wound-off spent cores from the roll changers on a common supply track. This can lead to interferences with the production process, in particular with more complex press lines.

DE 196 11 494 A1 discloses an unwinding system for wound rolls. The spent cores are moved out of the roll changer in their longitudinal direction.

WO 95/20537 A1 shows a roll changer, with an additional lifting arrangement for spent rolls inside the roll changer.

DE 78 17 607 U1 describes an arrangement for suspending and removing bales of material by the use of a carrier driven by a revolving chain.

EP 0 454 634 A2 shows a revolving transport chain for bringing fresh cores to a winding machine.

DE 42 15 739 C2 describes a crane-like arrangement for transporting cores from a storage trough to a container.

A transport cart with a lifting device for a spent roll receiver is known from GB 2 191 967 A.

U.S. Pat. No. 5,934,604 discloses a roll changer with a roll stand, in whose holder at least one roll of material is rotatably seated, and with a first transport device for transporting at least one fresh roll of material. A second transport device is arranged for removing an at least partially unwound spent core. The second transport device is passed through underneath the roll stand transversely with respect to the longitudinal axis of the installed roll of material.

JP 10-120258 A shows a roll changer where the removal of the spent core takes place in approximately the lowest position of the holders of the roll changer.

SUMMARY OF THE INVENTION

The object of the present invention is directed to providing roll changers with a roll stand, and to a method for disposing of spent cores.

In accordance with the present invention, this object is attained by the provision of a roll changer that has a roll stand with a holder which supports at least one roll of material. A transport device is used to transport fresh rolls and spent cores. The transport device passes through underneath the roll stand in a direction transverse to the longitudinal axis of the installed roll of material. Guide elements are arranged between the holder and the transport device. The transport device is continuously operated regardless of its load of spent cores. The holder is arranged at its lowest position during roll delivery. The spent cores can be placed in an elevatable receiving trough and then placed on a conveyor. The spent cores are released from the holder and delivered to a conveyor.

One advantage of a roll changer with a transport arrangement, in accordance with the present inventions lies in that a fixedly installed transport arrangement is provided on the roll changer, by the use of which the at least partially wound-off spent cores can be removed from the roll changer following the opening of the holders. In other words, this means that a separate transport track is being provided for the disposal of the spent cores, on which separate transport track only the spent cores are removed from the roll changer. As a result, the transport track which is used for supplying full rolls to the roll changer is relieved of spent core logistic duties and the logistics of the production processes, as a whole, are simplified. Because core containers no longer need to be transported to the individual roll changers for carrying away the spent cores, the opportunity for storing additional rolls of material in the supply system is created, instead of using that space for storage of the core containers. As a whole, reduced cycling times of the supply of the individual roll changers with rolls result, since fresh materials and spent cores are supplied or removed on separate tracks.

In accordance with a preferred embodiment of the present invention, the transport device is arranged in such a way that it is passed transversely underneath the roll changer with respect to the longitudinal axis of the installed web of material. Because of this, following the opening of the holders in the roll changer, the spent cores reach the transport device under the force of their inherent weight. In this way, separate drive mechanisms for use in transporting the spent cores from the holder to the transport device can be omitted.

Depending on the intended use, it can be advantageous to provide guide devices, for example in the form of elastic straps and/or inclined planes, between the holder for the spent cores in the roll changer and the transport device arranged underneath that holder. By the use of these guide arrangements, the course of the movement of the spent cores from the holder in the roll changer to the transport device is determined in a defined manner, so that interferences, such as, for example, stuck spent cores, can be prevented. For example, it is possible to reduce the maximum drop height of a spent core by the provision of inclined planes. Because the spent core rolls off downward on the inclined plane it, in the process, continuously travels the difference between the levels of the holder and the transport device. Furthermore, prior to opening the holder, the roll changer, with the holder supporting the spent core, should be moved in such a way that the least possible level difference exists between the spent core and the transport device. When the roll changer has reached this lowest, ejection position, for example when it is in a vertical position of the roll stand, the holder is opened and the spent core falls onto the transport device that is located underneath the holder.

If several roll changers are provided in a web-processing machine, the transport device can be arranged in such a way that it extends between at least two roll changers. In this way, it is possible to remove the spent cores from one or from several roll changers with one transport device.

In a preferred embodiment of the present invention, the transport device is continuously driven, independently of its load of spent cores. It is possible to achieve, by this, that the spent cores can be ejected from the roll changers at any time and can be removed by the transport device. Thus, a special triggering of the transport device, independently of the disposal requirements of the roll changers, can be omitted.

The way that the transport device is structurally configured is basically somewhat arbitrary. It is particularly advantageous if the transport device is configured, at least over portions, to revolve in an enclosed manner. For example, conveyor belts or chain conveyors can be utilized for constituting the transport device in accordance with the present invention. Depending on the required length of the transport device, it is also possible to arrange several such revolving conveyor belts or chain conveyors one behind the other.

In order to be able to transmit the transport movement of the transport device to the spent cores, engagement elements can be provided on the transport device. These engagement elements can, for example, protrude past the revolving conveyor belt or chain conveyor and can rest against the spent cores. By the provision of engagement elements, having an appropriate protruding length, it is also possible to convey the spent cores upward, starting at a defined initial point, without the spent cores rolling opposite their transport direction.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
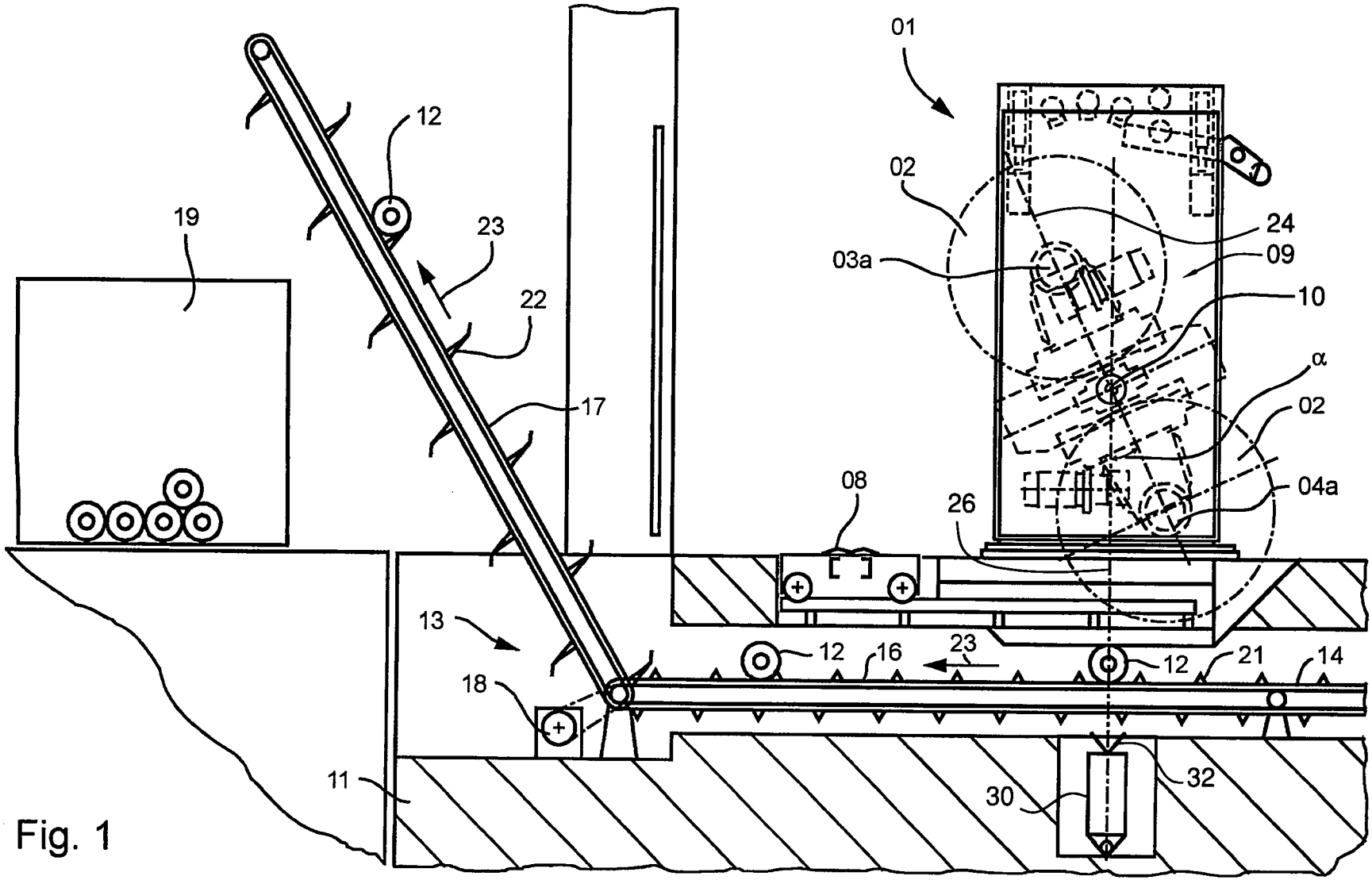
FIG. 1, a side elevation view, partly in cross-section of a roll changer with a transport device in accordance with the present invention, and in FIG. 2, a transverse elevation view, partly in cross-section, of the roll changer with transport device, as shown in FIG. 1.
Figure 2:
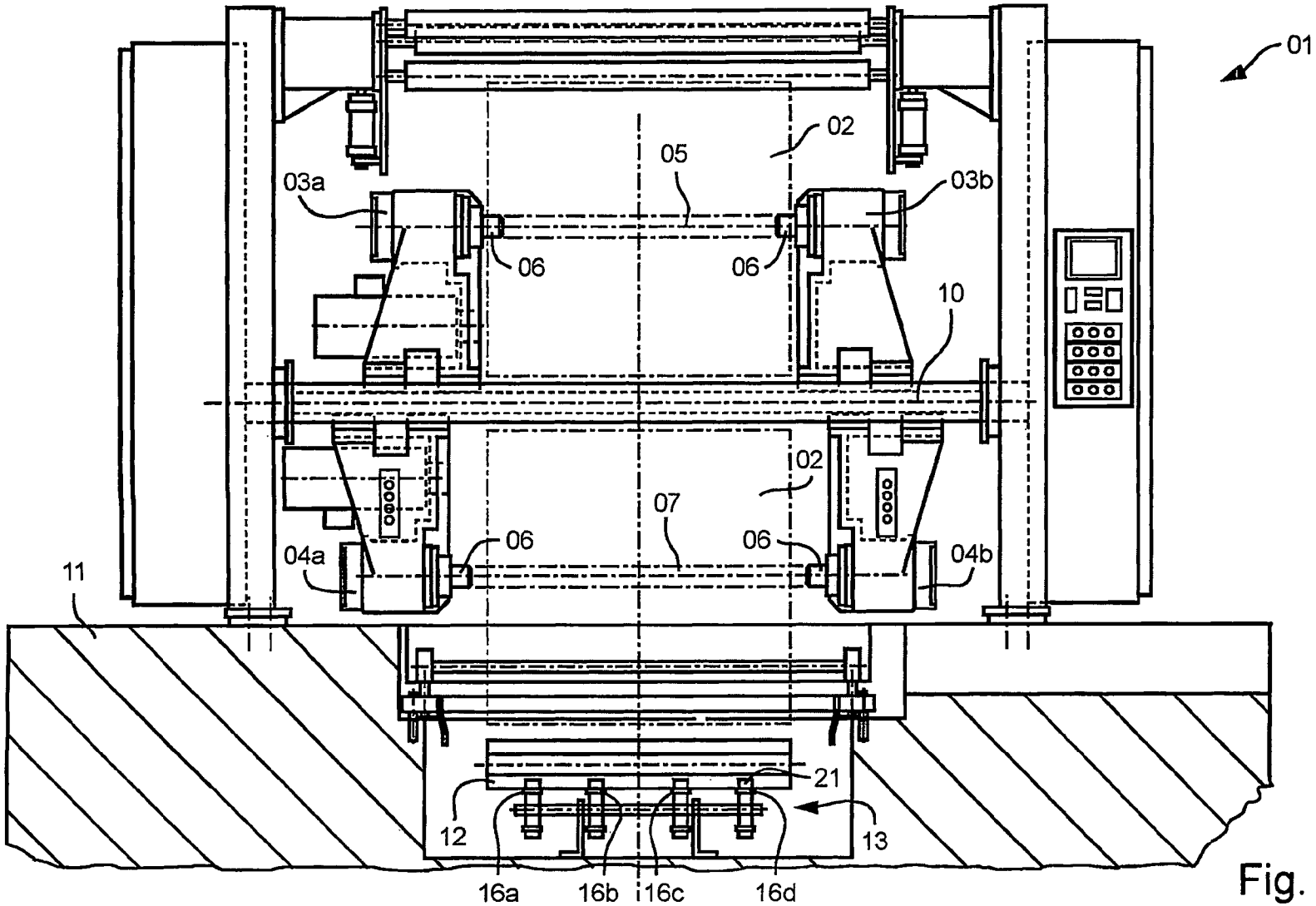

Referring initially to FIG. 1, there may be seen a preferred embodiment of a roll changer with a transport device in accordance with the present invention. To supply a web-processing machine, such as, for example a printing press, which is not specifically represented in FIG. 1, with rolls 02 of material, for example with paper rolls 02, several roll changers 01 are provided and are arranged in line one behind the other. Only the roll changer 01 that arranged at the extreme left of the not depicted printing press is represented in FIGS. 1 and 2.

As depicted in FIG. 1, two rolls 02 of material, for example two paper rolls 02, can be stored in each roll changer 01. Here, holders 03*a* and 03*b*, or 04*a* and 04*b*, each of which holders is provided with an arbor 06, as seen in FIG. 2 at its end, support the rolls 02. For fastening the rolls 02 on holders 03 or 04, or for opening the holders 03 or 04 to release the rolls 02, the holders 03 or 04 can be moved laterally toward each other or can be moved laterally away from each other. In the course of such a movement of the holders 03 or 04 together, the arbors 06 of the respective holders 03 or 04 are introduced into cores 07 which are arranged in the center of the rolls 02 and which are centered between the holders 03 or 04, and the inserted arbors 06 are fixed in place there by the use of spreading elements, which are not specifically depicted.

A transport system, with driveable transport carts 08 on each of which a fresh paper roll 02 can be transported, is used to supply the roll changers 01 with fresh paper rolls 02. In the course of a roll change performed by the roll changer 01, a roll stand 09, which includes the roll holders 03 and 04, is pivoted around a pivot shaft 10 of the roll stand 09 to position the holders 03 or 04 in accordance with the desired position of the paper rolls 02. The holders 03 and 04 are pivotable through a circular path of 360° around the central, horizontally extending pivot shaft 10 of the roll stand 09. A straight connecting line 24 extending between the pivot shaft 10 of the roll stand 09 and an axis of rotation 05 of the holder 03, 04, and a vertical line 26 extending through the pivot axis of the pivot shaft 10 enclose an opening angle $\alpha$, which is less than 15°. It is also conceivable for the opening angle $\alpha$ to be less than 5°.

Following the roll change, a spent core 12, that is the result of the unwinding of the roll 02 of material, must be removed from the roll changer 01. For this purpose, the roll changer 01 is initially pivoted sufficiently far so that the holders 03*a* and 03*b*, or 04*a* and 04*b*, together with the spent core 12 fastened between them, reach a lowest, ejection point in relation to the bottom of a base 11 of the roll changer 01. Once in this lowest, ejection position of the holders 03 or 04, the two holders 03*a* and 03*b*, or 04*a* and 04*b* are laterally moved apart. The arbors 06 are thus pulled laterally out of the spent core 12 and the spent core 12 is released. Following the opening of the holders 03*a* and 03*b*, or 04*a* and 04*b*, the spent core 12 falls onto a transport device 13, which is arranged underneath the roll changers 01, under the influence of gravity, and this released spent core 12 is removed from the roll changer 01 by the transport device 13. The transport device 13 is preferably arranged in the beneath, and in the center of the roll stand 09, as may be seen more clearly in FIG. 2.

The transport device 13 passes completely through the roll changer, transversely to the longitudinal axis of the roll 02 of material, and under the roll changer 01. As seen in FIG. 1, the transport device 13 extends from one side of the roll changer 01 to the other side of the roll changer 01.

A lifting device 30 may be anchored in the base 11 and which lifting device 30, after having been extended in the vertical direction toward the core axis, directly receives the spent core 12 in a trough-shaped device 32 and, following lowering of the lifting device 30, places the spent core 12 directly onto spaced conveyor belts 14, 16 that form the transport device 13. The transport device 13 must be briefly stopped for this spent core placement. In this way, a defined, axially accurate placement of the spent core 12 on the conveyor belts would be possible.

The transport device 13 is constituted by several transport conveyor belts 14, 16 and an elevating conveyor belt 17, which are arranged one behind the other in the transport direction, and which are driven by a common drive motor 18. The conveyor belts 14, 16 and 17 continuously revolve during the operation of the roll changer 01, so that spent cores 12 can be removed, at any time, and can be conveyed in the direction toward a core container 19. Each one of the conveyor belts 14, 16 and 17 is formed from four side-by-side revolving belt strands, with representative belt strands 16*a*, 16*b*, 16*c*, 16*d* for conveyor belt 16, being shown in FIG. 2.

Spaced apart, generally triangular-shaped, upwardly directed pickup elements 21 are provided on each of the conveyor belts 14 and 16 extending underneath the roll changers 01. They come to rest against the circumference of the spent cores 12 and are helpful for transmitting the transporting movement of the conveyor belts 14, 16 to the spent cores 12. Pickup elements 22, which protrude in a shovel-like manner, are arranged on the elevating conveyor belt 17 and protrude at a length or distance, corresponding to the diameter of the spent cores 12, past the belt strands of the elevating conveyor 17. It is achieved by this use of pickup element 22 that when the spent cores 12 are lifted from the level of the conveyor belts 14 and 16 to the level of the upper edge of the core container 19, the spent cores 12 do not roll back opposite to the direction of a spent core conveying movement 23, as seen in FIG. 1. As a whole, the conveying movement 23 of the transport device 13 extends substantially at right angles to the longitudinal axis of the spent cores 12.

By employing the transport device 13, with its component conveyor belts 14, 16 and 17, it is possible to provide for the automatic removal of spent cores 12 from several roll changers 01, which are arranged one behind the other, to the core container 19, which no longer needs to be transported to the individual roll changers 01. No additional space requirement arises through the use of the subject invention, since the conveyor belts 14 and 16 are sunken into the base 11 or into the hollow box base below the roll changers 01.

While a preferred embodiment of an automatic roll changer comprising a roll stand and a method for disposing of residual roll casings, in accordance with the present invention has been set forth fully and completely hereinabove, it will be apparent to one of skill in the art that various changes in, for example the type of printing press being supplied with the material web, the specific drive for the roll stand, and the like could be made without departing from the true spirit and scope of the present invention which is to be limited only by the appended claims.

What is claimed is:

1. A roll changer assembly comprising:

a roll stand;

at least one roll holder in said roll stand, said at least one roll holder being adapted to rotatably support a roll of material;

a fresh roll transport device adapted to transport a fresh roll of material to said roll stand;

a spent roll transport device adapted to transport an at least partially unwound, spent roll of material away from said roll stand, said spent roll transport device including at least one endless conveyor; and means supporting said spent roll transport device for movement of said at least one endless conveyor beneath said roll stand in a direction transverse to a longitudinal axis of a roll of material supported on said roll stand.

2. The roll changer assembly of claim 1 wherein said spent transport device extends beneath at least first and second roll stands.

3. The roll changer assembly of claim 1 further including at least one guide element between said at least one roll holder and said spent roll transport device.

4. The roll changer assembly of claim 3 wherein said guide device is beneath said at least one roll holder and said spent roll transport device is beneath said guide device.

5. The roll changer assembly of claim 4 wherein said guide device is selectively one of elastic straps and inclined planes.

6. The roll changer assembly of claim 4 wherein said spent rolls of material are moved from said at least one roll holder to said spent roll transport device by gravity.

7. The roll changer assembly of claim 1 wherein said spent roll transport device is continuously operated.

8. The roll changer assembly of claim 1 wherein said at least one roll holder is located in a lowermost position in said roll stand during delivery of said spent roll of material to said roll transport device, and wherein said spent roll transport device extends between at least two roll stands.

9. The roll changer assembly of claim 1 wherein said at least one roll holder is pivotable about a pivot axis of said roll stand.

10. The roll changer assembly of claim 9 wherein said at least one roll holder is pivotable about 360°.

11. The roll changer assembly of claim 9 wherein a first, straight line extending between an axis of rotation of said at least one roll holder and a pivot axis of said roll stand, and a second, vertical line enclose an opening angle of less than 15°.

12. The roll changer assembly of claim 11 wherein said opening angle is less than 5°.

13. The roll changer assembly of claim 1 further including a second roll holder in said roll stand.

14. The roll changer assembly of claim 1 wherein said fresh roll transport device is installed on said roll changer.

15. The roll changer assembly of claim 1 further including a base and wherein said spent roll transport device is in said base.

16. The roll changer assembly of claim 1 further including a spent roll receiving trough supported for movement and adapted to directly receive said spent roll of material, said spent roll transport device being adapted to receive said spent roll of material from said spent roll receiving trough.

17. The roll changer assembly of claim 1 further including a second roll stand and wherein said spent roll transport device extends between said roll stand and said second roll stand.

18. The roll changer assembly of claim 1 wherein said spent roll transport device is continuously operable.

19. The roll changer assembly of claim 1 wherein said spent roll transport device is embodied to revolve at least partially enclosed.

20. The roll changer assembly of claim 1 further including pickup elements on said spent roll transport device.

21. The roll changer assembly of claim 1 further including a core container, said spent roll transport device terminating at said core container.

22. The roll changer assembly of claim 1 wherein a conveying movement direction of said spent roll transport device is parallel with a transport direction of a web of material in said roll stand.

23. The roll changer assembly of claim 1 wherein said spent roll transport device is arrayed centrally of said roll stand.

24. A method for the disposal of spent rolls of material in a roll changer assembly including:

supporting spent rolls of material on a roll holder in said roll changer assembly;

moving said spent rolls of material supported on said roll holder to a delivery position;

releasing said spent rolls of material, in said delivery position, from said roll holder;

providing a spent roll of material transport conveyor, said material transport conveyor including an endless conveyor;

receiving said spent rolls of material released from said roll holder on said spent roll of material transport conveyor;

providing a core container; and using said spent roll of material transport conveyor for transporting said spent rolls of material from said roll changer to said core container.

* * * * *